US007503331B2

(12) United States Patent
Eng et al.

(10) Patent No.: US 7,503,331 B2
(45) Date of Patent: Mar. 17, 2009

(54) COSMETIC COMPACT

(75) Inventors: Serena Eng, Warren, NJ (US); Charles Chang, 155 Westview Rd., Wayne, NJ (US) 07470

(73) Assignee: Charles Chang, Wayne, NJ (US)

( * ) Notice: Subject to any disclaimer, the term of this patent is extended or adjusted under 35 U.S.C. 154(b) by 178 days.

(21) Appl. No.: 11/787,361

(22) Filed: Apr. 16, 2007

(65) Prior Publication Data

US 2008/0251096 A1 Oct. 16, 2008

(51) Int. Cl.
*A45D 33/00* (2006.01)
*B65D 69/00* (2006.01)

(52) U.S. Cl. ..... 132/294; 132/300; 206/581

(58) Field of Classification Search ..... 206/37, 206/38, 235, 581, 823; 132/286, 293–295, 132/297–300, 307, 317; 220/291, 811
See application file for complete search history.

(56) References Cited

U.S. PATENT DOCUMENTS

| | | | | |
|---|---|---|---|---|
| 1,362,808 | A | 12/1920 | McFarland | |
| 1,845,938 | A | 2/1932 | Shelgren | |
| 1,847,840 | A | 3/1932 | Levy et al. | |
| 1,900,089 | A | 3/1933 | Batchelor | |
| 2,141,815 | A | 12/1938 | Kelly | |
| 2,150,152 | A | 3/1939 | Campbell | |
| 6,129,089 | A * | 10/2000 | Yuhara | 132/300 |
| 6,138,686 | A * | 10/2000 | Yuhara | 132/294 |
| 6,173,719 | B1 * | 1/2001 | Petit | 132/294 |
| 6,336,460 | B2 * | 1/2002 | Yuhara | 132/295 |
| 6,526,990 | B1 * | 3/2003 | Yuhara | 132/307 |
| 7,314,051 | B2 * | 1/2008 | Yuhara et al. | 132/294 |
| 2006/0118454 | A1 * | 6/2006 | Kang, III | 206/581 |

FOREIGN PATENT DOCUMENTS

GB 2236673 A 4/1991

OTHER PUBLICATIONS

Sample (actual) of a prior art cosmetic powder jar, purchased on or around Sep. 1, 2006 by K. Gibner Lehmann, at Walgreens Pharmacy, Fairfield, CT; 2 sheets of photocopies of container box for above purchased sample. Sample identified as "Loose-To-Go Multi-Colored Loose Powder", manufactured by Physicians Formula.

* cited by examiner

*Primary Examiner*—Luan K Bui
(74) *Attorney, Agent, or Firm*—K. Gibner Lehmann

(57) ABSTRACT

A dual dispensing mode cosmetic compact for use with a cosmetic powder puff, cosmetic applicator sponge, or cosmetic brush, has a base member with an annular lip, a well to hold a cake of cosmetic material, and a closure lid receivable onto the base member. A scraper member located adjacent the well is engageable with the upper surface of the cosmetic cake. Finger-engageable structures adjacent to the well are turnable thereon, and there is a driving connection between the finger-engageable structures and the scraper member, which effects corresponding turning movement of the latter during turning of the finger-engageable structures. In one mode, the scraper member shaves off limited quantities of the upper surface of the cosmetic cake to produce controlled amounts of dust-like cosmetic powder particulates therefrom. In another mode, the scraper member is shifted by the user, to a second position remote from and outside of the annular lip. This second position fully exposes the upper surface of the cosmetic cake and enables direct access to the cake surface by a cosmetic powder puff, cosmetic applicator sponge, or cosmetic brush.

19 Claims, 11 Drawing Sheets

COSMETIC COMPACT

NO CROSS REFERENCES TO RELATED APPLICATIONS

Statement as to Rights to Inventions Made Under Federally Sponsored Research and Development Research and development of the present invention and application have not been Federally-sponsored, and no rights are given under any Federal program.

BACKGROUND OF THE INVENTION

1. Field of the Invention

This invention relates generally to cosmetic products, and more particularly to cosmetic compacts of the type carried on the person, in a pocketbook or purse.

2. Description of the Related Art Including Information Disclosed Under 37 CFR 1.97-1.99

The following patents are hereby made of record and are believed to constitute a sampling of existing prior art in the field to which the invention relates:

U.S. Pat. Nos.

1,362,808

1,845,938

1,847,840

1,900,089

2,150,152

2,141,815

Great Britain Patent Application No. GB 2 236 673A

British Published Application, No. GB 2 236 673A shows a cosmetic compact having an inner axially-shiftable, spring-biased compartment for storing a solid cake of cosmetic powder, and also having a circular scraper member with scraper lugs that engage the upper surface of the cake. The arrangement is such that the cosmetic cake is continually urged upwardly, into engagement with the scraper member. Manual turning of the latter results in pulverization of minute particles of the cake, and subsequent transfer of the particles through slits in the scraper member. The particles are then available to be picked up by a powder puff or dabber.

U.S. Pat. No. 1,847,840 shows a somewhat similar arrangement utilizing an internal compartment for holding cosmetic powder, a turnable member having scraper blades, and an apertured disk. When the turnable member is rotated, the blades force the powder from the compartment, up through holes in the apertured disk. The details of the operation are set forth in col. 1, line 32 through col. 2, line 72.

U.S. Pat. No. 1,900,089 describes a compact having a compartment which is divided into 4 sections by scraper blades, and wherein the user inverts the case to pour or dump powder onto the surface of a puff. Thereafter, the case is turned to an upright position, and the scraper is utilized to remove excess powder from the puff.

U.S. Pat. No. 1,362,808 involves a rouge holder having an apertured scraper disk (FIG. 2), that forms the upper wall of a chamber containing the rouge. The scraper disk has minute teeth that engage the surface of an applicator or puff. Turning of the latter rotates the scraper disk, which in turn shaves off small quantities of the rouge material. When the user removes the applicator, this shaved material in turn adheres to the fibers thereof, in the usual manner, for transfer to the user's cheeks.

Yet another cosmetic dispenser is described in U.S. Pat. No. 1,845,938. The embodiment of FIGS. 9 and 10 is of interest. A powder chamber is formed by a casing having a perforated retainer plate. The perforations enable small quantities of powder to be transferred to a puff during normal jostling of the casing. The puff is then ready for use in the usual manner.

Still another powder-type dispensing container is described in U.S. Pat. No. 2,150,152. A can-type body is provided with a lid having a dispensing nozzle, and a hand-operable plunger. The latter is connected with an internal combination spring and closure member. The closure member normally stoppers the nozzle. When the plunger is depressed, the closure member uncovers the nozzle, and the plunger simultaneously disturbs the contained powder such that a small quantity of it can be directed toward the nozzle and dispensed therethrough.

A further known construction for a dispenser is illustrated and described in U.S. Pat. No. 2,141,815. This structure also utilizes an inverted can-type body having a dispensing nozzle. Powder to be dispensed is stored in a chamber formed by the body. A control or measuring cylinder is disposed in the path between the chamber and the nozzle. The measuring cylinder can be manually turned by an external crank handle. The arrangement is such that a predetermined charge of powder is obtainable by mere turning of the handle through one-half a revolution. A scraper member adjacent the cylinder prevents undesirable build-up of material between uses.

It is considered that large scale commercialization of the devices noted above has not occurred. Undue complexity may have been a concern. Alternately, promotional considerations may have prevented the disclosed arrangements from being made and sold in quantity.

It is further noted that some of the devices discussed above did not relate directly to cosmetic applications. Accordingly, the relatively high demand today, for treatments to the face, hands, and body, has resulted in the need for large-scale, inexpensive yet reliable methods and fixtures for storing and dispensing health-care and/or beauty products.

SUMMARY OF THE INVENTION

The above shortcomings of prior cosmetic and like dispensers are largely overcome by the present invention, which has for an object the provision of a novel and improved dual-mode cosmetic compact which is simple in construction, and which provides different multiple dispensing options as to the cosmetic material contained therein.

A related object of the invention is to provide an improved dual-mode cosmetic compact of the type noted above, that can be readily stored in a pocketbook or purse, and thereafter readied for use by the consumer, with a minimum of effort.

A further object of the invention is to provide an improved dual-mode cosmetic compact as above characterized, wherein there are virtually eliminated problems with spillage of product, thus making use of the compact especially neat and tidy.

Still another object of the invention is to provide an improved dual-mode cosmetic compact of the kind indicated, which can be readily molded in simple mold cavities, and assembled with a minimum of time and with no special equipment being required.

The arrangement is such that the compact can function in a direct-contact mode with respect to the cosmetic cake or material contained therein, or, by means of a simple shifting of an intermediate member in the compact, can function in a shaved powder mode wherein the cosmetic cake can be first subjected to gentle abrasion by the intermediate member, and the resulting pulverized material made directly available for application by means of a conventional cosmetic powder puff, cosmetic applicator sponge, or cosmetic brush.

The above objects are accomplished in a preferred embodiment of the invention, by a cosmetic compact for use with a cosmetic powder puff, cosmetic applicator sponge, or cosmetic brush, comprising in combination a base member of generally circular configuration, having an annular lip and having a well for storage of a cake of cosmetic material in compressed powder form, a lid cooperable with and receivable on the base member, for selectively closing off the base member during storage and shipping, and a scraper member disposed adjacent the well of the base member and being engageable with the upper surface of the cosmetic cake. In addition, there are finger-engageable means adjacent to the well of the base member, these being turnable thereon, and keying means connecting the scraper member to the finger-engageable means such that turning of the latter will impart corresponding rotary movement of the scraper member and consequent shaving of the upper surface of the cake to produce controlled quantities of cosmetic powder particulates therefrom. Additional means are provided, enabling the scraper member to be swung from a first position overlying and engaging the upper surface of the cake, to a second position remote from and outside of the annular lip, this second position exposing the upper surface of the cake and enabling direct access to this cake surface by the usual cosmetic powder puff, cosmetic applicator sponge, or cosmetic brush.

As noted above, dual-mode dispensing is possible, either by direct access to the cake by the puff or brush, or by alternately shaving of the cake surface by an intermediate member, to provide a dust-like powder residue thereon, that can be taken up by such a puff or brush.

Other features and advantages will hereinafter appear.

BRIEF DESCRIPTION OF THE DRAWINGS

In the drawings, illustrating a preferred embodiment of the invention:

FIG. 5 shows the location of the FIG. 13 detail view.

DESCRIPTION OF THE PREFERRED EMBODIMENT

Referring first to FIGS. 1-3, 6 and 7, there is illustrated a dual-mode cosmetic compact 10 constructed in accordance with the principles of the present invention.

Figure 6:
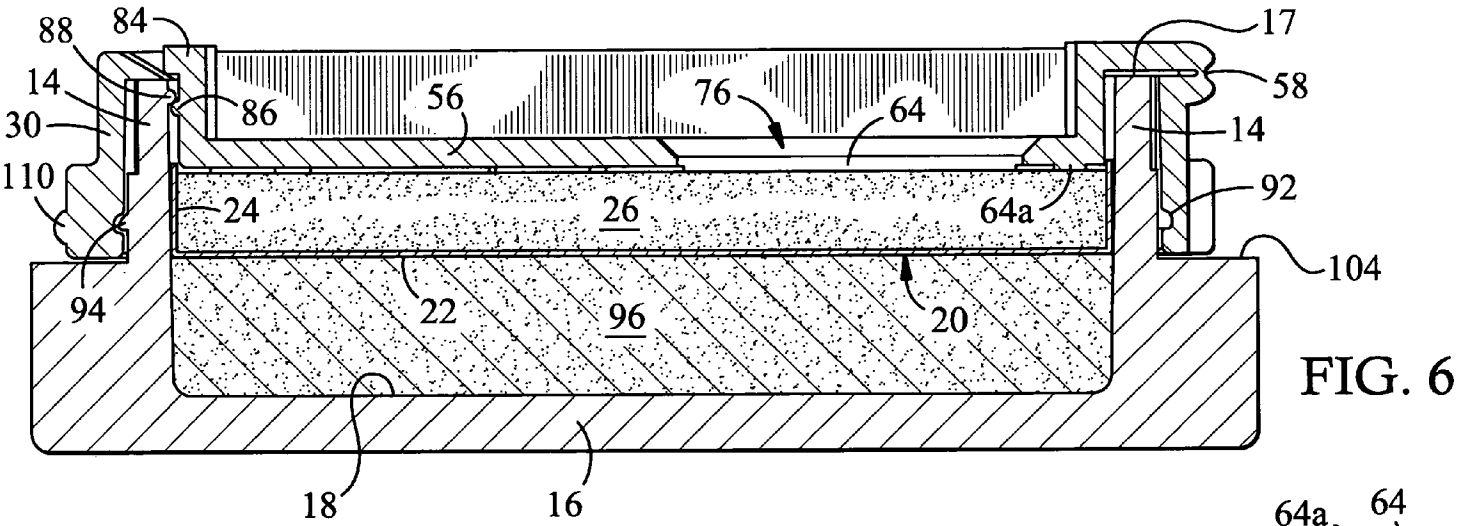
FIG. 6 is an axial section taken on the line 6-6 of FIG. 4.
Figure 7:
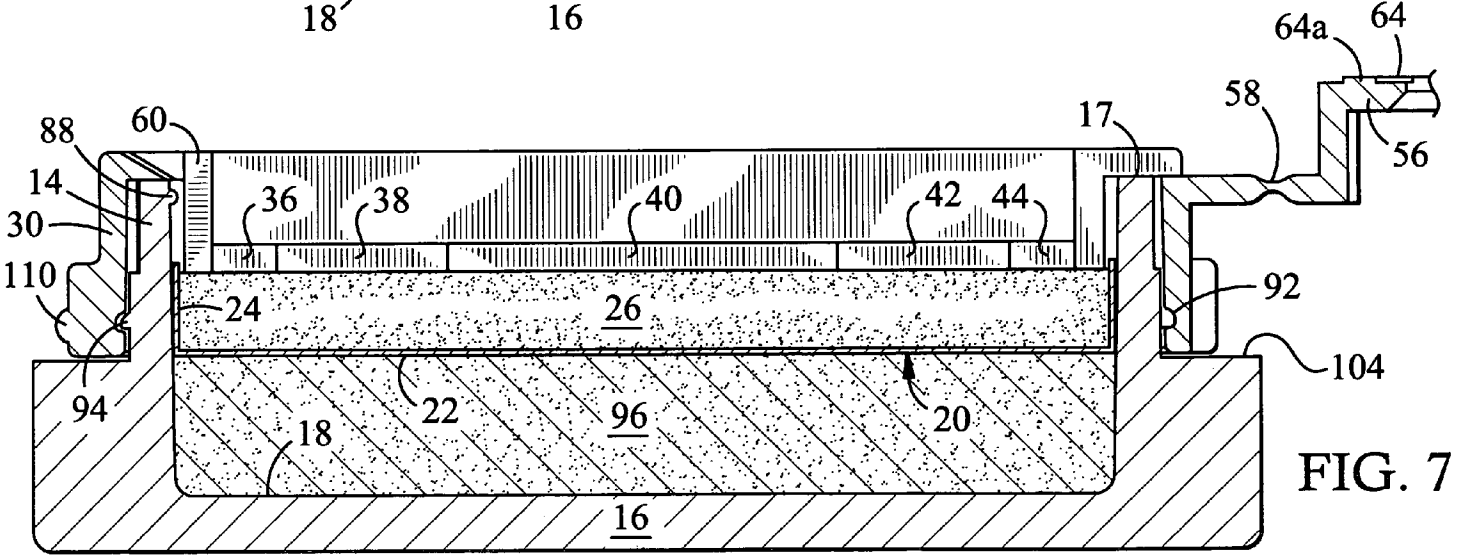
FIG. 7 is an axial section taken on the line 7-7 of FIG. 5.
Figure 8:
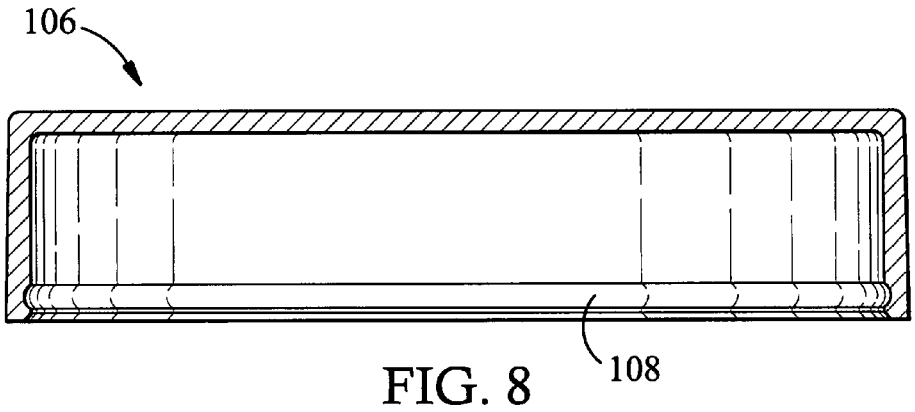
FIG. 8 is a vertical section of the cover or lid of the compact of the invention.
Figure 9:
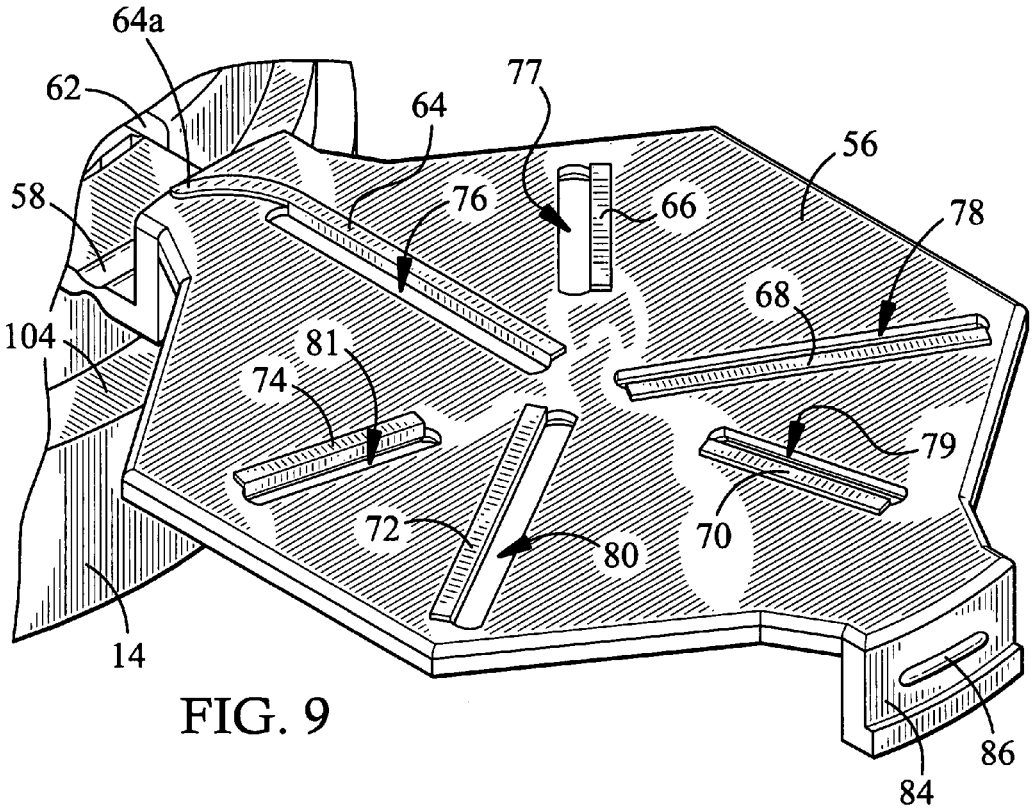
FIG. 9 is a fragmentary view of the scraper member of the compact, shown in an open or remote position with respect to the base member of the compact. The view corresponds to the showing of FIG. 5.
Figure 14:
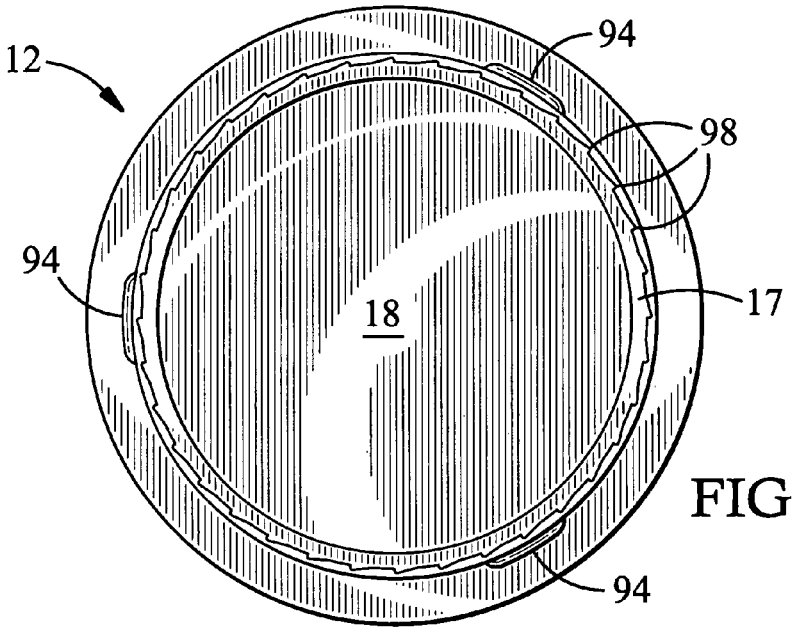
FIG. 14 is a top plan view of the base member of the compact of the invention.

The compact comprises a base member generally designated 12 in the form of an upwardly facing cup having an upstanding annular wall 14 and a transverse bottom wall 16 providing a central well 18, FIGS. 6, 7, and 14. The top of the annular wall 14 forms a lip 17, FIG. 3, on the well 18. Receivable in the well 18 is a product-carrying cup 20 having a bottom wall 22 and a substantially cylindrical side wall 24, and containing a quantity of cosmetic powder 26 preferably in the form of a pressed cosmetic cake.

Figure 2:
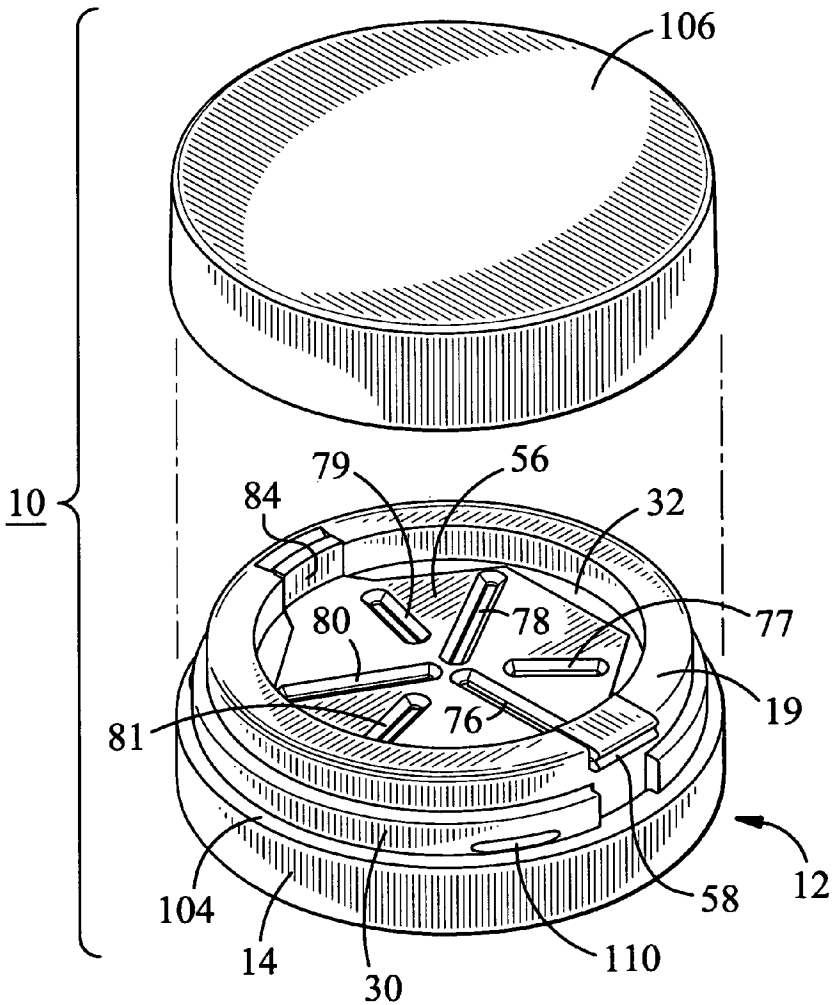
FIG. 2 is a perspective view of the compact of FIG. 1, with the lid removed.
Figure 1:
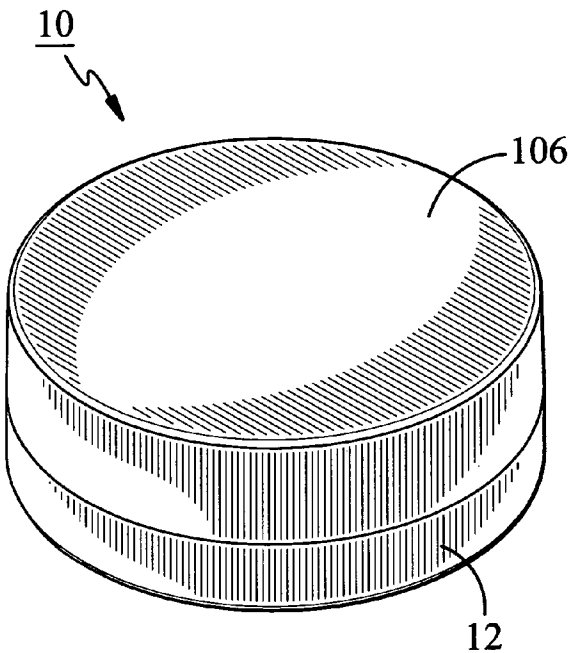
FIG. 1 is a perspective view of the cosmetic compact of the present invention, shown with its cap or lid assembled, for storage or shipping purposes.
Figure 3:
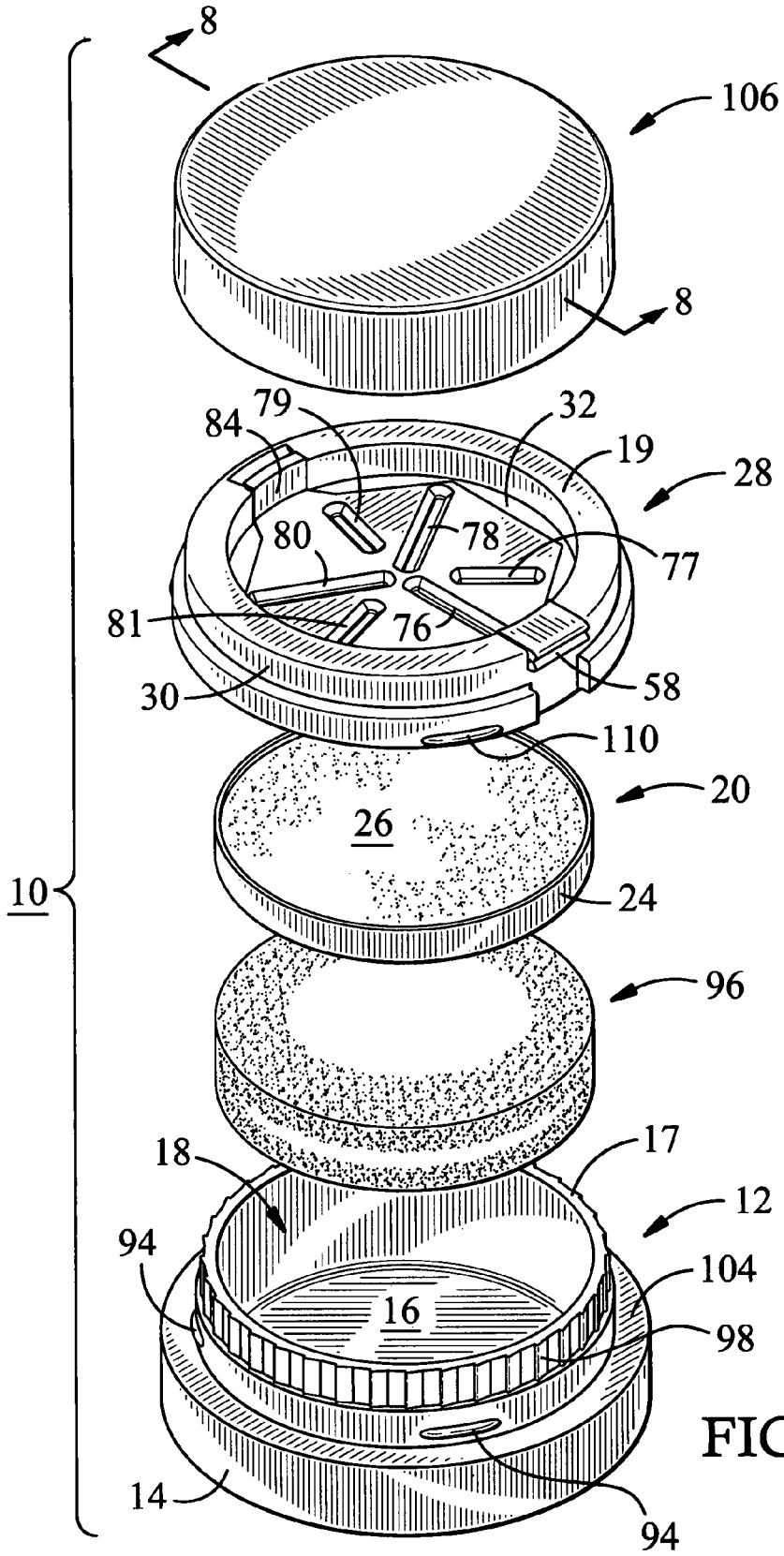
FIG. 3 is an exploded view of the various parts of the cosmetic compact of FIGS. 1 and 2.
Figure 4:
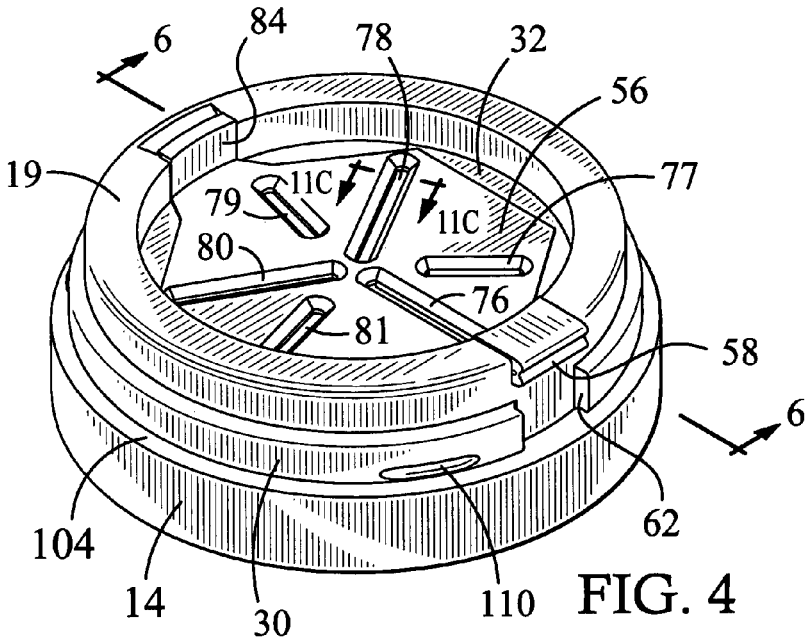
FIG. 4 is a perspective view of the compact of the present invention. A scraper member component part is disposed in a nested condition in a base member part of the compact.
Figure 5:
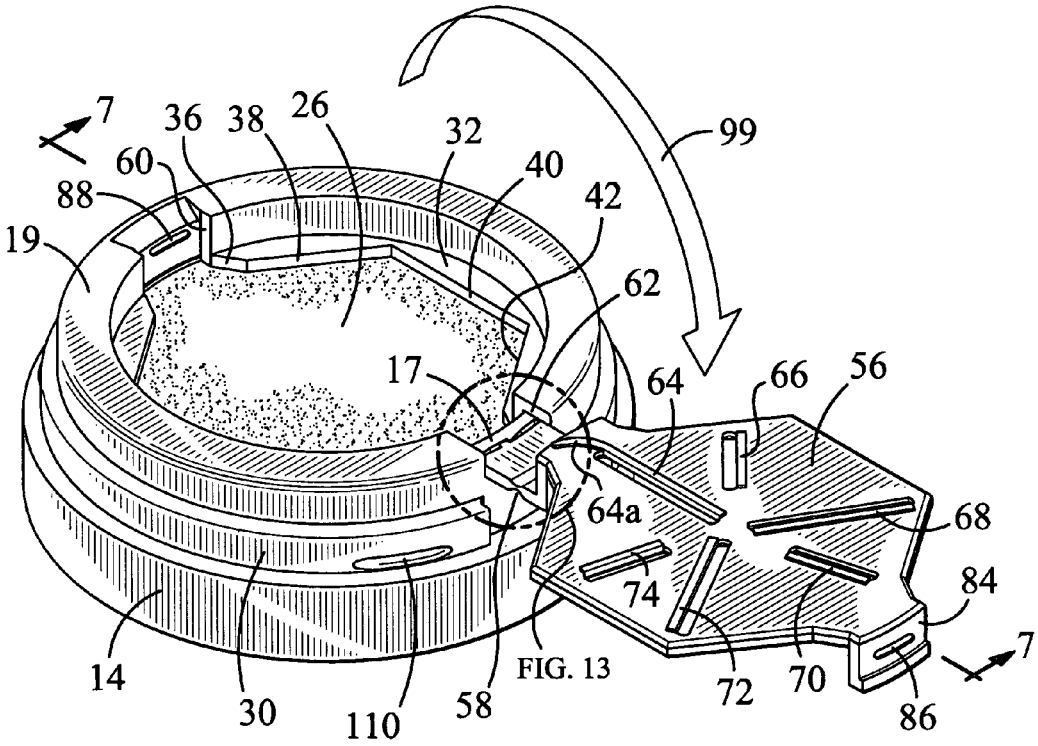
FIG. 5 is a perspective view like that of FIG. 4, wherein the scraper member part is disposed in an open or remote position with respect to the base member of the compact.

Turnably receivable on the base member 12 is a finger-engageable rotatable actuator member 28 particularly illustrated in FIGS. 3-5. The actuator member 28 has an annular side wall 30 and a peripheral two-piece inner shelf 32, 34 which shown in FIG. 10. The shelf 32, 34 is carried by the annular side wall 14, and is substantially rigid therewith.

In accordance with the invention there is provided a novel scraper member 56 that is hingedly connected to the annular side wall 30 of the actuator member 28 as illustrated in FIGS. 6, 7, 9, 10 and 13. The scraper member 56 is substantially flat, having upper and lower surfaces. It can be manually swung by the user about the hinge 58, between a retracted position shown in FIGS. 3, 4 and 6, and an extended position, shown in FIGS. 5, 7, 9 and 10.

Figure 10:
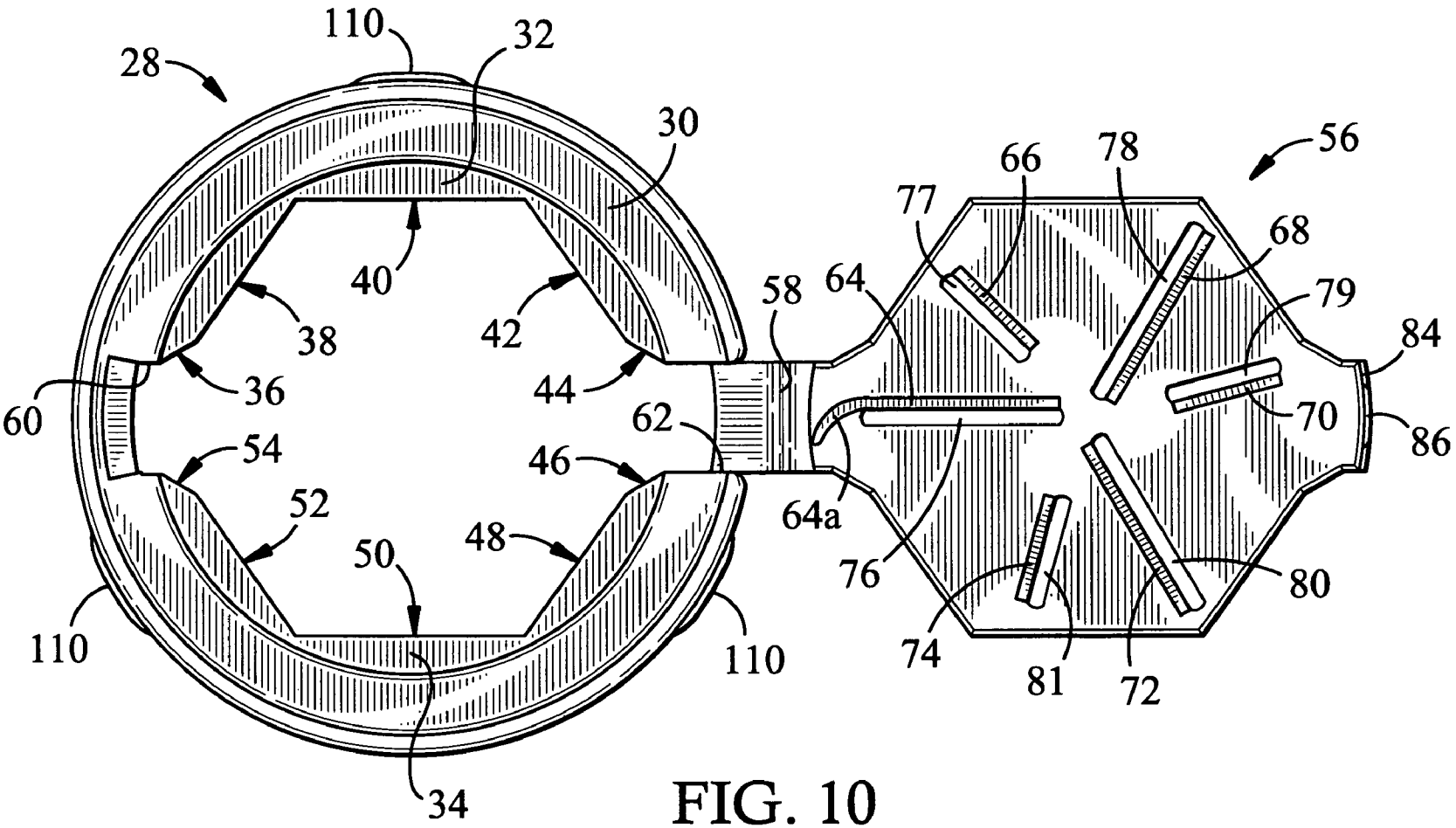
FIG. 10 is a top plan view of the combined actuator member and scraper member of the compact, with the scraper member occupying its remote or open position.

The annular side wall 30 of the actuator member 28 is notched at two places, designated 60 and 62, respectively, FIGS. 5 and 10. The notches in effect key the scraper member 56 to the annular wall 30, and thus establish a driving connection between the wall 30 and the scraper member 56.

Referring to FIG. 10 and as noted above, the two piece inner shelf 32, 34 is carried by the actuator member wall 30. It has inwardly facing edges 36, 38, 40, 42, 44, 46, 48, 50, 52, and 54 respectively, which generally define the outline of a polygon. The shape of the polygon is complementary to the shape of the scraper member 56, such that the latter can nest snugly with the adjacent edges of the inner shelf 32, 34, as in FIGS. 2 and 4.

Further by the invention, the scraper member 56 has a series of radially extending scraper blades 64, 66, 68, 70, 72, and 74, shown as being 6 in number, although a different number of such blades could be provided instead, if desired. The scraper blades 64-74 extend slightly below the plane of the remainder of the scraper member 56, such that they engage and press against the upper surface of the pressed cosmetic cake 26 when the scraper member 56 is disposed in the position of FIGS. 2, 4, and 6.

Figure 11A:
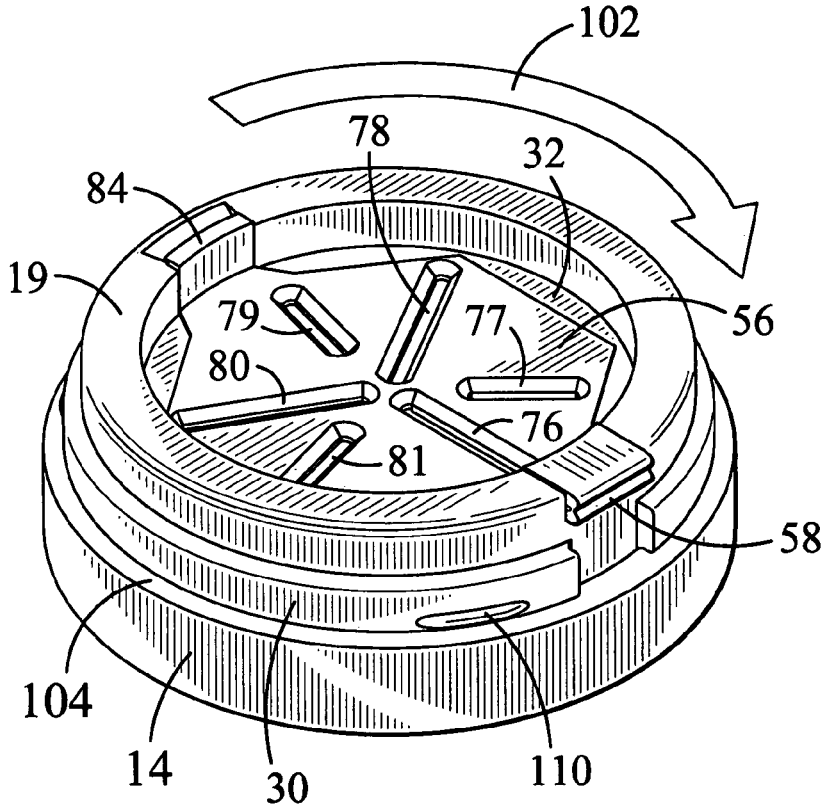
FIG. 11A is a perspective view of the assembled base member and actuator member of the compact.
Figure 11B:
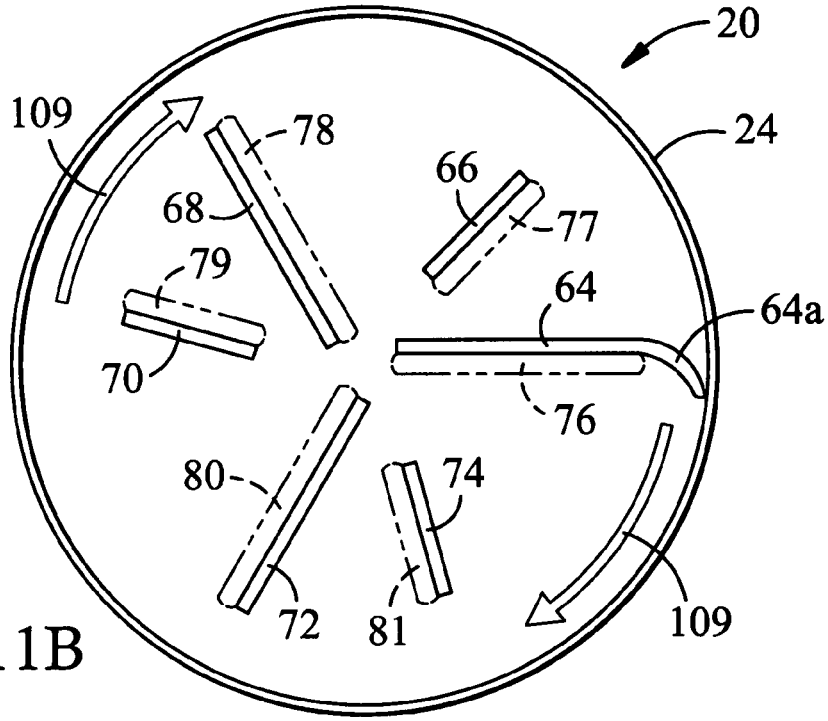
FIG. 11B is a diagrammatic view of the scraper blades of the scraper member of the compact, as the blades would appear when projected over a product-carrying cup containing a new cake of cosmetic material. Product transfer slots associated with each scraper blade are illustrated in dotted outline in this figure.
Figure 11C:
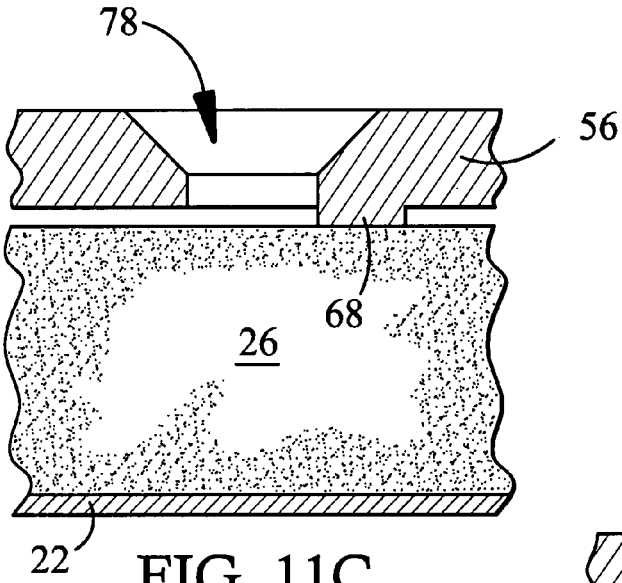
FIG. 11C is a fragmentary section of a scraper blade of the scraper member of the compact, taken on the line 11C—11C of FIG. 4. This view shows one scraper blade in engagement with the upper surface of the cosmetic cake component of the compact.
Figure 11D:
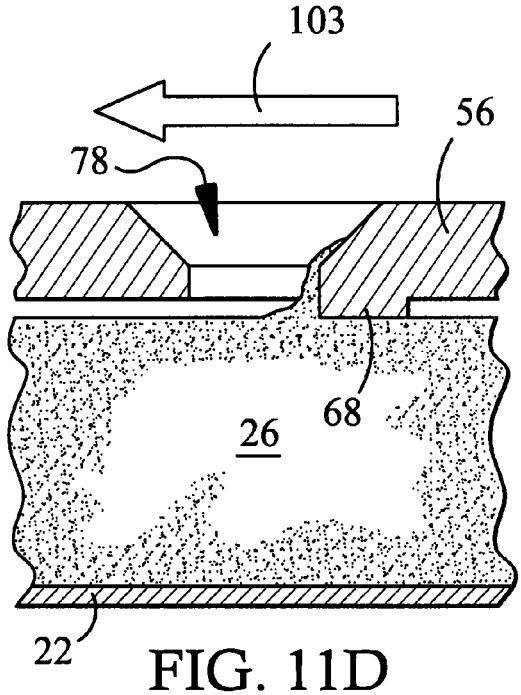
FIG. 11D is a fragmentary section similar to FIG. 11C, showing the scraper blade beginning to shave off small quantities of dust-like particulates from the surface of the cosmetic cake.
Figure 11E:
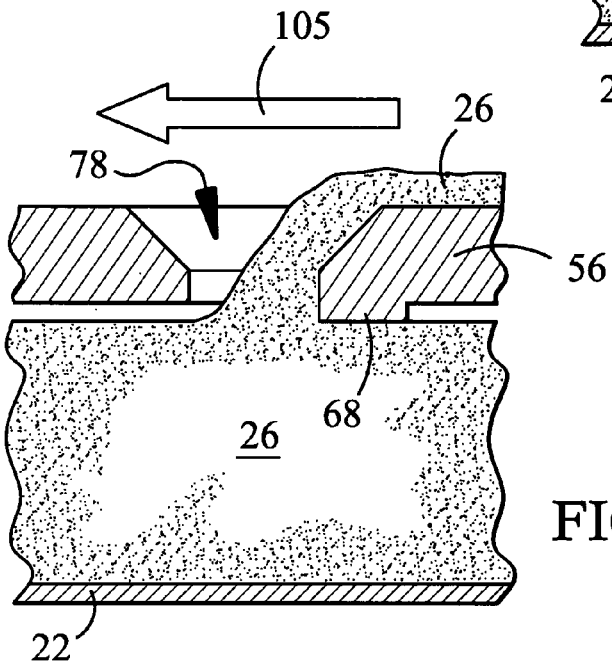
FIG. 11E is a fragmentary section similar to FIGS. 11C and 11D, and illustrating the action of the scraper blade after it has scraped off a larger quantity of powder from the cosmetic cake and wherein the particulates begin to accumulate on the upper surface of the scraper member.

FIGS. 11A, 11C, 11D, and 11E show the details of a typical scraper blade. In practice, the scraper blades 64-74 can be of alternating length, except that preferably one scraper blade, 64*a*, is made slightly longer than the remaining scraper blades, so as to be capable of intimate contact with the outer part or periphery of the cosmetic cake 26. Adjacent to each scraper blade are elongate product transfer slots 76, 77, 78, 79, 80, and 81 respectively. The slots provide multiple clearance openings through which the powder passes as it is being scraped from the cake. Reference is made to FIGS. 11C, 11D and 11E respectively, where the arrows 103 and 105 show the scraping action of one of the scraper blades 68 and its adjacent product transfer slot 78.

As noted, one edge of the scraper member 56 is hinged to the annular wall 14 of the base member 12. The opposite edge thereof carries a finger-engageable tab 84, FIGS. 4 and 6, with a detent nib 86, FIGS. 5 and 6, that mates with a corresponding nib 88 on the annular wall 14 of the base member 12 when the scraper member 56 is disposed in the nested position of FIGS. 2-4 and 6.

The actuator member 28 has an internal groove 92 (FIGS. 7, 12A and 12B) at its underside, arranged to receive with a sliding fit, a series of external nibs 94 on the base member 12. Reference is also made to FIGS. 6 and 7. During assembly, the actuator member 28 (FIG. 3) is merely placed onto the base member 12, and the nibs 94 received in the groove 92, whereby the actuator member 28 is held captive, but can be turned with respect to the base member 12.

Referring again to FIGS. 3, 6 and 7, there is provided a disk 96 of resilient sponge or sponge-like material, either plastic or rubber, natural or synthetic, which is interposed between the bottom wall 16 of the base member 12 and the bottom wall 22 of the product-carrying cup 20. The arrangement is such that the sponge/disk 96 is initially under moderate compression so as to apply a spring bias to the product-carrying cup 20 in an upward direction. This in turn, maintains physical contact of the upper surface of the cosmetic cake 26 with the scraper member 56 when the latter is disposed in the nested position of FIGS. 2, 4, and 6.

Figure 13:
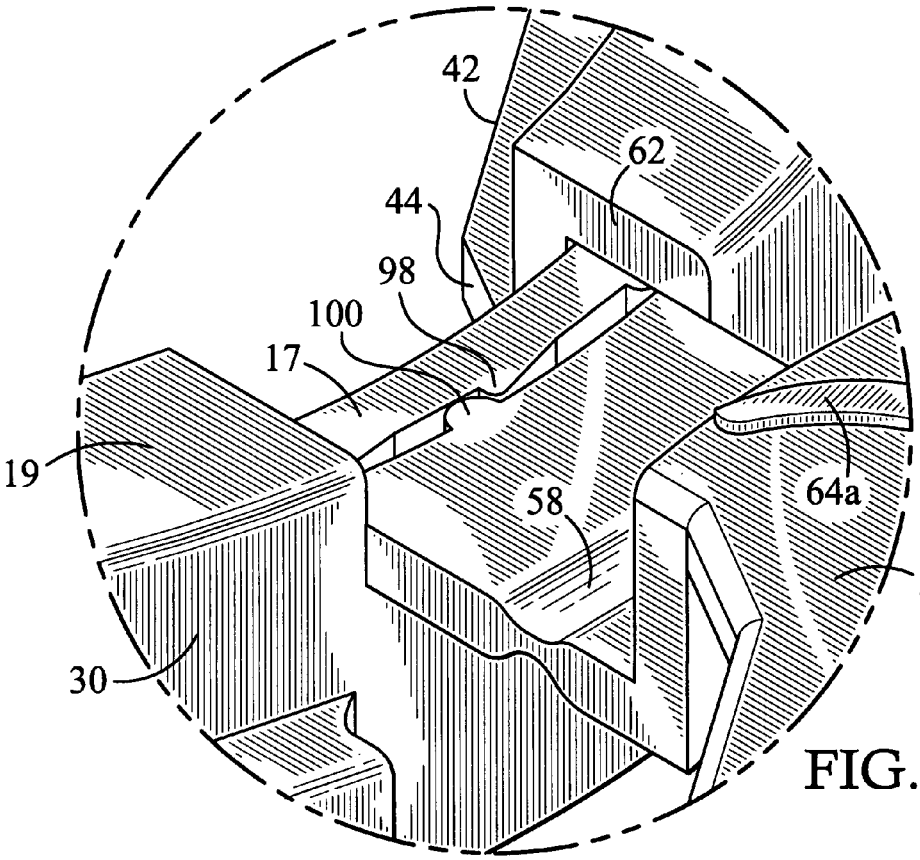
FIG. 13 is a detail view of a ratchet arrangement component for effecting one-way rotation of the actuator member with respect to the base member of the compact of FIG. 5.

As noted, the actuator member 28 is turnable on the base member 12. However, one-way turning direction is necessary because of the shape of the scraper blades 64-74. In accomplishing this, the annular wall 14 of the base member 12 is provided with a series of ratchet teeth 98, as illustrated in FIGS. 13 and 14. One of these is shown in detail, in FIG. 13. The ratchet teeth 98 are engaged by a corresponding inwardly-extending tooth 100 on the base member wall 14, FIG. 3. The teeth 98 are normally hidden from view when the compact is in use. Accordingly turning in the direction of the arrow 102 in FIG. 11A is permitted, whereas turning in an opposite direction is prevented by the back-check action of the tooth 100 and the ratchet teeth 98.

Referring again to FIGS. 6 and 7, the base member 12 has a peripheral upwardly facing annular shoulder or shelf 104, which is arranged to receive a closure cap or lid 106, shown in FIGS. 1-3 and 8. The lid 106 has an inner peripheral groove 108, and the annular wall 30 of the actuator member 28 has a series of external nibs 110. The nibs 110 are dimensioned to be received in the groove 108 of the lid 106, and hold the lid captive, for storage and/or display of the compact.

The operation of the improved cosmetic compact of the invention can now be understood. With the lid 108 removed, there is provided a dual mode of dispensing, involving two modes for accessing the cosmetic powder at the cosmetic cake 26. One mode involves use of the scraper member 56, and the other involves displacement of the scraper member 56 to the position of FIGS. 5, 7 and 10. In the nested position of FIGS. 2, 4 and 6, the user slowly rotates the actuator member 28 (and its nested scraper member 56) on the base member 12. The revolving movement of the scraper blades 64-74 with respect to the upper surface of the cosmetic cake is diagrammatically illustrated by the arrows 103 and 105 respectively in FIGS. 11D and 11E. There thus results a shaving off of small quantities of cosmetic powder 26, as shown in detail in FIGS. 11C, 11D, and 11E. Depending on the amount of powder desired, more or less turning is initiated.

By way of illustration, FIG. 11B shows a projection of the scraper blades 64-74 of the scraper member 56 over the surface of the cosmetic cake 26 as well as the locations of the respective product transfer slots 76-81. The two arrows 109 indicate the direction of rotation of the scraper member 56. As utilized in the one mode of dispensing, shaved particulates from the cosmetic cake are produced when the scraper member 56 is rotated in the direction indicated, as explained previously.

Figure 12B:
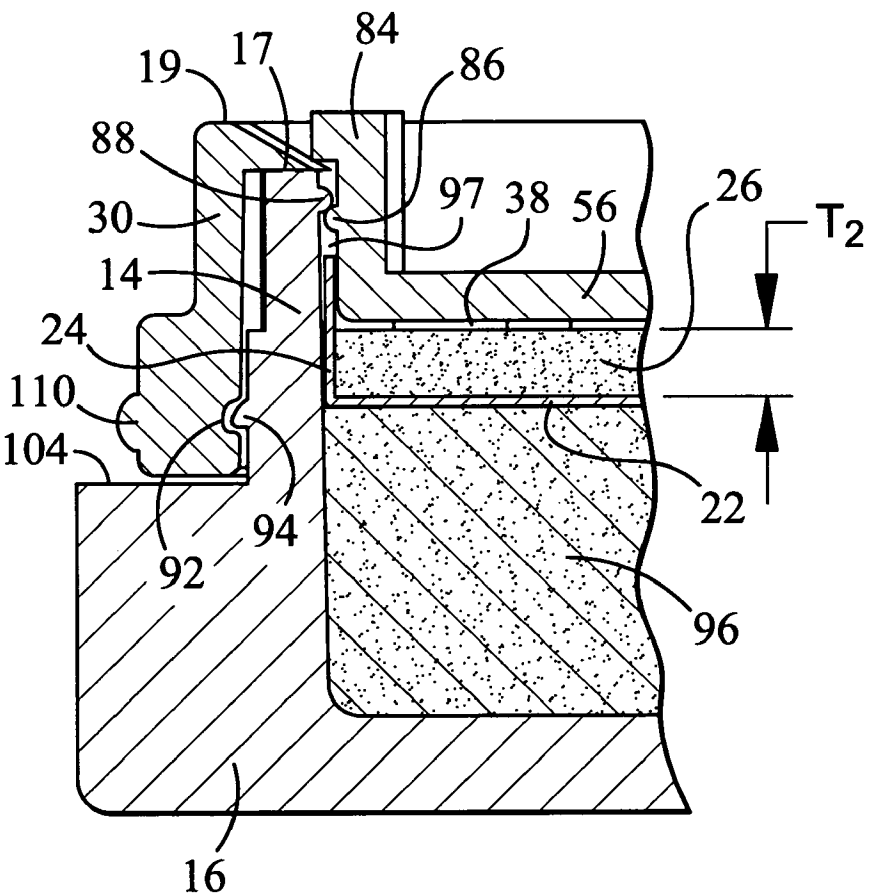
FIG. 12B is an enlarged, fragmentary axial section similar to FIG. 12A, except showing the product-carrying cup as partially depleted of its cosmetic cake, and wherein the cup has been raised in the base member well by a springy or resilient sponge material between the cup and the base member's bottom wall.
Figure 12A:
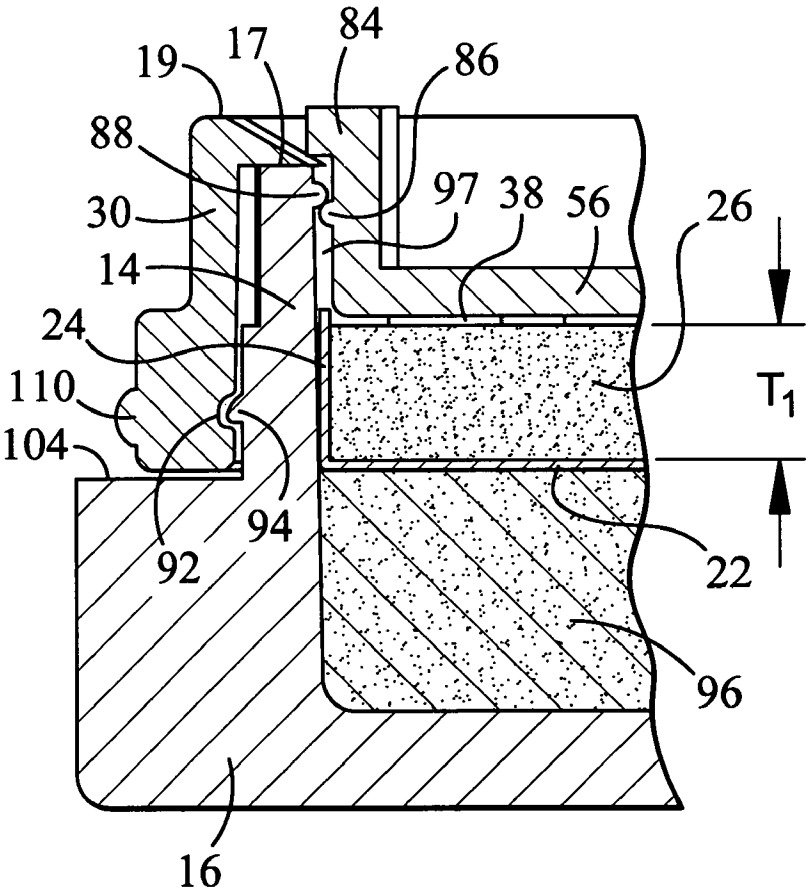
FIG. 12A is an enlarged, fragmentary axial section through the left portion of the cosmetic compact of FIG. 5. This view shows the product-carrying cup as substantially full of cosmetic cake powder.

Referring to FIGS. 6 and 7, over time, as the cosmetic cake 26 becomes depleted the product-carrying cup 20, being upwardly biased by the resilient, compressed sponge 96, is raised with respect to the base member 12 and its well 17. The arrangement is such that the sponge normally maintains firm contact between the upper surface of the cosmetic cake 26 and the scraper member 26. In FIGS. 12A and 12B, the progression of the cup 20 is illustrated by the dimensions indicated by the letters $T_1$ and $T_2$. In particular, $T_1$ represents the thickness of the cosmetic cake 26 in its new, unused condition, whereas $T_2$ represents the lesser thickness as part of the upper surface of the cake has been shaved. Under this circumstance, the product-carrying cup has been biased upwardly as in FIG. 12B, by the expanded sponge disk 96, FIG. 12B. In these figures there is further illustrated an annular space 97 which receives the side wall 24 of the product-carrying cup 20 as the latter is shifted upwardly by the sponge 96.

Figure 15:
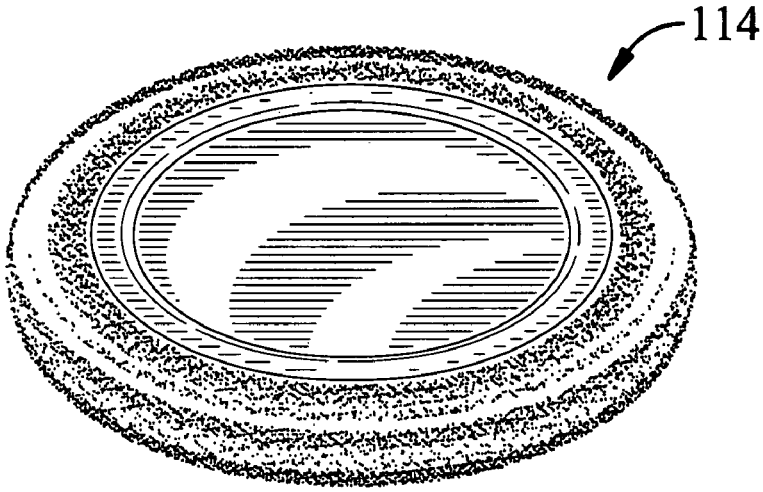
FIG. 15 is a perspective view of a cosmetic powder puff for use with the compact of the invention.
Figure 16:
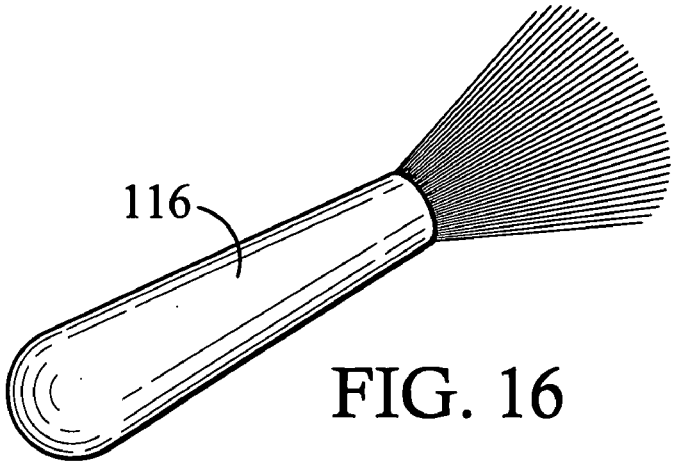
FIG. 16 is a perspective view of a cosmetic applicator brush for use with the compact of the invention.
Figure 17:
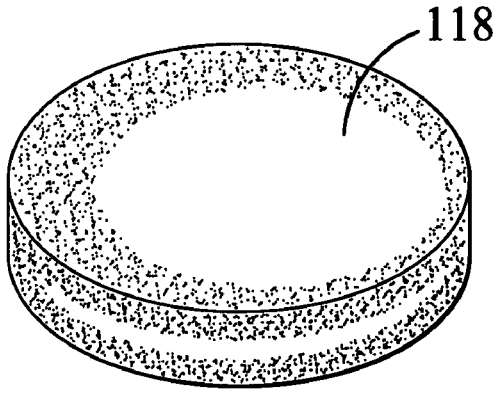
FIG. 17 is a perspective view of a cosmetic applicator sponge for use with the compact of the invention.

The powder so produced is accumulated on the surface of the scraper member, in flat areas thereof between the scraper blades. The upper surfaces of the two inner shelves 32 and 34 also serve to catch and hold any powder which lands outside the scraper member 56 per se. Application of a suitable puff 114 or brush 116, FIGS. 15 and 16 respectively, or applicator sponge, FIG. 17, then will attract the granular powder in the usual manner, for powdering the face, etc.

In the second mode of dispensing the cosmetic powder 26 from the cosmetic cake, the user lifts the tab 84 with his finger, causing by-pass of the detent nibs 86 and 88, and swings the scraper member 56 up and out over the annular wall 30 of the actuator member 28, as in FIGS. 5 and 7. This movement is indicated by the arrow 99 in FIG. 5. Consequently the upper surface of the cosmetic cake is now exposed, with the exception of the part that underlies the shelves 32 and 34. The user can then, with an appropriate powder puff, cosmetic brush, or cosmetic sponge, rub the cake upper surface and pick up a suitable quantity of particulate cosmetic powder from the cake directly. As a consequence, finer control of the absorption of powder is made realizable with the second mode or arrangement just described.

When the user has finished, he returns the scraper member 56 to its nested position, and assembles the lid 106 to the combined base member 12 and actuator member 28.

From the above it can be seen that there has been described a novel and improved dual-mode dispenser type cosmetic compact which is simple in its structure, readily assembled with automated assembly equipment, and especially convenient to carry and use. The disclosed arrangement is thus seen to represent a distinct advance and improvement in the cosmetic field.

Each and every one of the appended claims defines an aspect of the invention which is separate and distinct from all others, and accordingly it is intended that each claim be treated as such in any determination of novelty or validity.

Variations and modifications are possible without departing from the spirit of the invention, and portions of the improvement can be used without others.

(intentionally left blank)

LIST OF REFERENCE NUMERALS

10 Cosmetic compact
12 Base member
14 Base member annular wall
16 Base member transverse bottom wall
17 Lip of well 18
18 Cup-like well in base member
20 Product-carrying cup
22 Product-carrying cup bottom wall
24 Product-carrying cup circular side wall
26 Cosmetic powder, cake
28 Rotatable actuator member
30 Actuator member annular side wall
32, 34 Two-piece inner shelf
36, 38, 40, 42, 44, 46, 48, 50, 52, 54 Edge portions of inner arcuate shelves
56 Scraper member
58 Hinge
60, 62 Notches in annular wall
64, 66, 68, 70, 72, 74 Radially-extending scraper blades
76, 77, 78, 79, 80, 81 Elongate product transfer slots
84 Finger-engageable tab
86 Detent nib
88 Corresponding detent nib
92 Internal groove
94 External nibs
96 Disk of sponge/plastic
97 Space
98 Ratchet teeth
99 Arrow
100 Inwardly extending ratchet tooth
102 Arrow, direction of turning
103 Arrow
104 Upwardly facing shoulder or shelf
105 Arrow
106 Closure cap or lid
108 Lid inner peripheral groove
109 Arrows.
110 Nibs receivable in peripheral groove
112 Minute, dust-like particles of cosmetic powder
114 Cosmetic powder puff
116 Cosmetic applicator brush
118 Cosmetic applicator sponge.

What is claimed is:

1. A cosmetic compact, for use with a cosmetic powder puff, cosmetic applicator sponge, or cosmetic brush, said compact comprising in combination:

a) a base member of generally circular configuration, said base member having an annular lip and having a well for storage of a cake of cosmetic material in compressed powder form, b) a lid cooperable with and receivable onto said base member, for selectively closing off the base member during storage and shipping, c) a scraper member disposed adjacent the well of the base member and being engageable with the upper surface of the cosmetic cake, d) turnable finger-engageable means on the base member and disposed adjacent to the well thereof, said finger-engageable means being drivingly connected to the scraper member to thereby effect turning movement of the latter when the finger-engageable means is turned with respect to the base member, said scraper member when turned, shaving the upper surface of the cosmetic cake to produce cosmetic powder therefrom, and e) additional means enabling the scraper member to be swung from a first position overlying and engaging the upper surface of the cosmetic cake, to a second position removed from said cake upper surface and disposed outside of said lip, while in said second position said scraper member exposing the upper surface of the cosmetic cake and enabling direct access thereto by said cosmetic powder puff, cosmetic applicator sponge, or cosmetic brush.

2. A cosmetic compact as set forth in claim 1, wherein:

a) said finger-engageable means comprises an annular actuator member, turnable on the said base member, said actuator member having said driving connection with respect to the scraper member.

3. A cosmetic compact as set forth in claim 1, wherein:

a) said finger-engageable means and said base member having cooperable, one-way back-check lugs to enable solely unidirectional turning of the finger-engageable means with respect to the base member.

4. A cosmetic compact as set forth in claim 3, wherein:

a) one of said back-check lugs comprise a ratchet track on said base member, and the other of said back-check lugs being engageable with said ratchet track.

5. A cosmetic compact as set forth in claim 1, wherein:

a) said well has a transverse bottom wall, b) a product-carrying cup disposed in the well of the base member, c) said product-carrying cup being movable in a direction toward and away from the transverse bottom wall of the well.

6. A cosmetic compact as set forth in claim 5, and further including:

a) compression-type spring means engaging the bottom of the well and the product-carrying cup, to bias the latter in a direction away from the bottom wall of said well.

7. A cosmetic compact as set forth in claim 2, and further including:

a) a hinge connecting said actuator member and said scraper member, said hinge enabling the scraper member to be manually swung between said first and second positions.

8. A cosmetic compact as set forth in claim 7, and further including:

a) a finger-engageable tab on said scraper member, disposed opposite the location of said hinge, for effecting lifting movement of the scraper member from said first position toward its second position.

9. A cosmetic compact as set forth in claim 7, wherein:

a) said actuator member has oppositely disposed notches in its annular wall, b) said hinge being disposed in one of said notches, and said finger-engageable tab being disposed in the other of said notches when the scraper member is disposed in said first position, c) the engagement of said hinge and tab with the walls of the notches effecting said driving connection between the finger-engageable means and the scraper member.

10. A cosmetic compact as set forth in claim 1, and further including:

a) cooperable retainer means on said base member and said finger-engageable means for maintaining the latter captive while simultaneously permitting turning thereof with respect to the base member.

11. A cosmetic compact as set forth in claim 8, and further including:

a) cooperable nibs on said scraper member and said actuator member, disposed adjacent to said finger-engageable tab, and engageable with one another to normally maintain said scraper member in said first position.

12. A cosmetic compact as set forth in claim 1, wherein:

a) said scraper member has a plurality of scraper blades extending downwardly into engagement with the cosmetic cake in the product-carrying cup.

13. A cosmetic compact as set forth in claim 12, wherein:

a) said scraper member has an under surface and a top surface, and further has a plurality of slits respectively adjacent to said scraper blades, said slits enabling cosmetic powder from said blades to pass through the scraper member from the under surface thereof to the top surface thereof.

14. A cosmetic compact as set forth in claim 12, wherein:

a) said scraper blades are of differing length.

15. A cosmetic compact as set forth in claim 13, wherein:

a) one of said scraper blades is axially longer than the remaining scraper blades, in order to contact outermost peripheral portions of the cosmetic cake.

16. A cosmetic compact as set forth in claim 2, wherein:

a) said actuator member has an inner peripheral shelf formation, forming a polygonal configuration, b) said scraper member having a polygonal shape substantially congruent with the polygonal configuration of the shelf formation.

17. A cosmetic compact as set forth in claim 2, wherein:

a) said scraper member and said actuator member are molded as a single integral piece.

18. A cosmetic compact as set forth in claim 6, wherein:

a) said spring means comprises a piece of resilient material selected from the group consisting of natural sponge, synthetic sponge, plastic, rubber, and composite substance.

19. In a cosmetic compact of the type for use with a cosmetic powder puff, cosmetic applicator sponge, or cosmetic brush, the compact comprising the combination of a base member having a well for storage of a cake of cosmetic material in compressed powder form, and a lid cooperable with and receivable onto said base member, said compact further having a scraper member engageable with the upper surface of the cosmetic cake, finger-engageable means disposed adjacent to the well of the base member and being turnable thereon, said finger-engageable means further having a driving connection to the scraper member such that manual turning of it will impart corresponding turning movement of the scraper member with respect to the cosmetic cake and consequent shaving of the cosmetic cake to produce cosmetic powder therefrom, the improvement comprising additional means enabling the scraper member to be swung from a first position overlying and engaging the upper surface of the cosmetic cake, to a second position remote from said cake and disposed outside of said well, said second position exposing the upper surface of the cosmetic cake and enabling direct access thereto by the cosmetic powder puff, cosmetic applicator sponge, or cosmetic brush.

* * * * *